US009771133B2

(12) United States Patent
Palmer

(10) Patent No.: US 9,771,133 B2
(45) Date of Patent: Sep. 26, 2017

(54) TEAR RESISTANT WATER MAT

(71) Applicant: Jeffrey Alan Palmer, Cedar Rapids, IA (US)

(72) Inventor: Jeffrey Alan Palmer, Cedar Rapids, IA (US)

( * ) Notice: Subject to any disclaimer, the term of this patent is extended or adjusted under 35 U.S.C. 154(b) by 0 days.

(21) Appl. No.: 15/253,081

(22) Filed: Aug. 31, 2016

(65) Prior Publication Data

US 2017/0066511 A1 Mar. 9, 2017

Related U.S. Application Data

(60) Provisional application No. 62/215,453, filed on Sep. 8, 2015.

(51) Int. Cl.

| | |
|---|---|
| ***B63B 35/73*** | (2006.01) |
| ***B63G 13/00*** | (2006.01) |
| *B63B 17/04* | (2006.01) |

(52) U.S. Cl.

CPC ..... *B63B 35/73* (2013.01); *B63G 13/00* (2013.01); *B63B 2017/045* (2013.01); *B63B 2035/737* (2013.01); *B63B 2231/40* (2013.01)

(58) Field of Classification Search

CPC ..... B63B 35/73
USPC ..... 441/129
See application file for complete search history.

(56) References Cited

U.S. PATENT DOCUMENTS

| | | | | |
|---|---|---|---|---|
| 2,356,391 | A * | 8/1944 | Fluor, Jr. | B63J 2/06 114/211 |
| 3,639,927 | A * | 2/1972 | Munch | A47C 27/146 5/648 |
| 4,448,112 | A * | 5/1984 | Soderberg | B60H 1/26 114/211 |
| 4,535,715 | A * | 8/1985 | McIntosh | B63J 2/10 114/211 |
| 4,568,293 | A * | 2/1986 | Yazaki | B63B 35/731 114/211 |
| 4,634,393 | A * | 1/1987 | Wood | A47C 15/006 441/129 |
| 4,711,193 | A * | 12/1987 | Latza | B63J 2/02 114/177 |
| 4,811,680 | A * | 3/1989 | Genth | B63B 19/14 114/201 R |
| 4,811,682 | A * | 3/1989 | Hwang | B63B 7/087 114/345 |
| 4,836,814 | A * | 6/1989 | Bambara | B29C 44/34 156/216 |
| 4,991,532 | A * | 2/1991 | Locke | B63J 2/06 114/211 |

(Continued)

*Primary Examiner* — Lars A Olson
*Assistant Examiner* — Jovon Hayes
(74) *Attorney, Agent, or Firm* — Dunlap Bennett & Ludwig PLLC

(57) ABSTRACT

A water mat is provided. The mat includes a first buoyant layer, a netting layer and a second buoyant layer. The netting layer may be adhered in between the upper and lower foam layers. The netting layer may include crisscrossing fibers having a first set of fibers substantially parallel relative to each other and a second set of fibers substantially parallel relative to each other. The first set of fibers crisscross with the second set of fibers, and are thereby perpendicular relative to the second set of fibers. The netting layer provides additional strength to the mat.

10 Claims, 1 Drawing Sheet

(56) References Cited

U.S. PATENT DOCUMENTS 4,996,937 A * 3/1991 Niina ..... B63H 21/213 114/144 R
5,176,551 A * 1/1993 Blanchard ..... F02M 35/10013 440/77
5,195,445 A * 3/1993 Riddles ..... B63B 19/14 114/201 R
5,331,911 A * 7/1994 Bost ..... B63J 4/004 114/211
5,417,597 A * 5/1995 Levedahl ..... B63B 3/08 114/65 R
5,490,474 A * 2/1996 Ikeda ..... B63B 35/731 114/343
5,520,561 A * 5/1996 Langenohl ..... B63B 35/78 441/129
5,709,163 A * 1/1998 Livingston ..... B63B 19/04 114/211
5,787,833 A * 8/1998 Lewis ..... B63J 2/06 114/183 R
5,791,952 A * 8/1998 Trinkl ..... B63J 2/10 114/211
5,853,309 A * 12/1998 Biggs ..... A47C 15/006 114/294
5,885,123 A * 3/1999 Clifford ..... B63B 35/78 441/129
6,167,658 B1 * 1/2001 Weiner ..... B63B 17/02 114/361
6,276,290 B1 * 8/2001 Yamada ..... B63B 19/14 114/55.51
6,484,657 B1 * 11/2002 Donovan ..... B63J 2/04 114/201 R
6,712,689 B2 * 3/2004 Clarkson ..... B63J 2/04 114/211
6,863,582 B1 * 3/2005 Wynne ..... B63B 35/731 114/211
6,887,186 B2 * 5/2005 Bambanian ..... A63B 31/00 441/129
6,957,990 B2 * 10/2005 Lowe ..... B60L 11/02 114/189
7,001,232 B2 * 2/2006 Montgomery ..... F02M 35/168 114/55.56
7,004,095 B2 * 2/2006 Bronneberg ..... B63B 57/04 114/211
7,305,930 B1 * 12/2007 Beal ..... B63B 3/66 114/211
7,744,736 B2 6/2010 Murer
8,312,829 B2 * 11/2012 Black ..... B63J 2/04 114/211
8,707,881 B2 * 4/2014 Armstrong ..... B63B 1/125 114/211
9,198,518 B1 * 12/2015 Mayer ..... A47C 15/006
2002/0011199 A1 * 1/2002 Barsumian ..... B60V 1/08 114/67 A
2005/0181688 A1 * 8/2005 Roberts ..... B63B 35/73 441/36
2006/0116039 A1 * 6/2006 Pole, III ..... B63B 35/34 441/129
2011/0159756 A1 * 6/2011 Shen ..... B29C 43/021 441/129
2013/0025527 A1 * 1/2013 Cooney ..... B63J 2/08 114/363
2014/0360421 A1 * 12/2014 Hopper ..... B63J 2/08 114/343
2017/0066511 A1 * 3/2017 Palmer ..... B63B 35/73

* cited by examiner

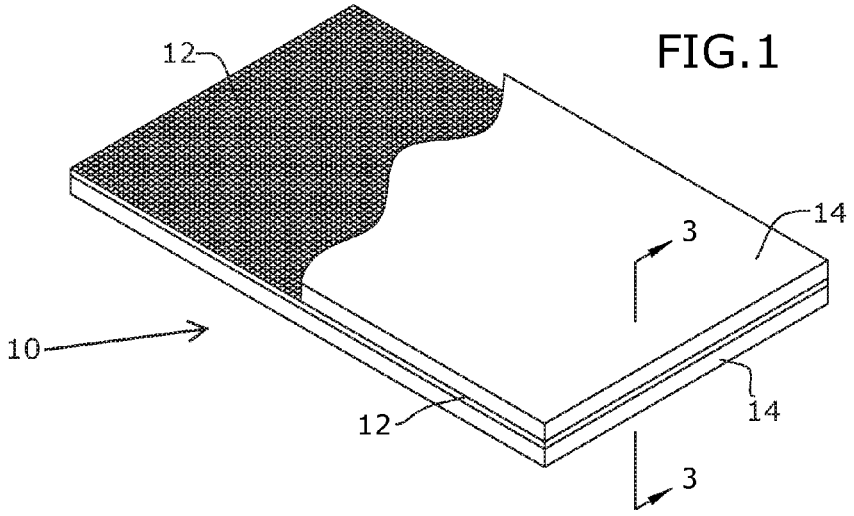
FIG.1
FIG.2
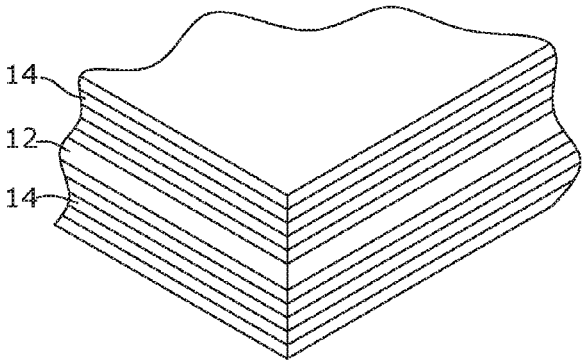
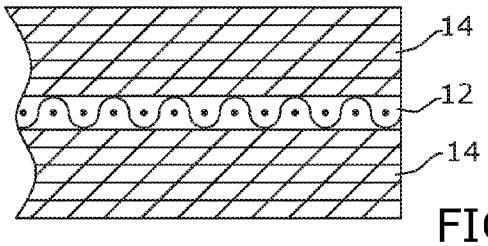
FIG.3

TEAR RESISTANT WATER MAT

CROSS-REFERENCE TO RELATED APPLICATION

This application claims the benefit of priority of U.S. provisional application No. 62/215,453, filed Sep. 8, 2015, the contents of which are herein incorporated by reference.

BACKGROUND OF THE INVENTION

The present invention relates to a water mat and, more particularly, to a tear resistant water mat.

A water mat is a mat that is able to support one or more individuals while floating on water. A water mat may be used in a playing environment, such as a body of water. The body water may include a pool, a pond, a lake, a river, the ocean and the like. Water mats are expensive and are prone to damage, such as holes and tears, from standing, running and jumping on them, as they are comprised of one or more layers of foam.

As can be seen, there is a need for an improved floating mat that is tear resistant.

SUMMARY OF THE INVENTION

In one aspect of the present invention, a floatable water mat comprises: a first buoyant layer comprising at least one layer of foam, a top surface and a bottom surface opposite the top surface; and a netting comprising crisscrossing fibers adhered to the bottom surface of the first buoyant layer.

In another aspect of the present invention, a floatable water mat comprises: a first buoyant layer comprising at least one layer of foam, a top surface and a bottom surface opposite the top surface; a netting comprising crisscrossing fibers disposed at the bottom surface of the first buoyant layer; and a second buoyant layer comprising at least one layer of foam, a top surface and a bottom surface opposite the top surface, wherein the top surface of the second buoyant layer is laminated to the bottom surface of the first buoyant layer sandwiching the netting therebetween.

These and other features, aspects and advantages of the present invention will become better understood with reference to the following drawings, description and claims.

BRIEF DESCRIPTION OF THE DRAWINGS

FIG. 1 is a perspective view of an embodiment of the present invention;

FIG. 2 is an enlarged perspective view of an embodiment of the present invention; and FIG. 3 is a section detail view of the present invention taken along line 3-3 in FIG. 1.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

The present invention includes a layer of netting laminated between layers of foam on a recreational water floating mat to reduce the incidence of tears and holes due from usage. The netting between the layers prevents holes from developing as it will support the weight of a person on their feet, whether standing, walking, or running. Foam has excellent buoyancy, but lacks durability when it comes to the pressures of a person standing on it with nothing but water below to support the load. Laminating in this netting more evenly disperses the load.

Referring to FIGS. 1 through 3, the mat 10 includes a first buoyant layer 14, a netting layer 12 and a second buoyant layer 14. The netting layer 14 may be adhered in between the upper and lower foam layers 12. The netting layer 14 may include crisscrossing fibers having a first set of fibers substantially parallel relative to each other and a second set of fibers substantially parallel relative to each other. The first set of fibers crisscross with the second set of fibers, and are thereby perpendicular relative to the second set of fibers. The netting layer 14 may be made of nylon, monofiliment, fiberglass or the like.

Each of the buoyant layers 14 may be constructed from one or more foam layers, e.g., a polyolefin or polyethylene foam layer. The buoyant layers 14 may include other materials such as polyurethane. The buoyant layers 14 are preferably non-inflatable, but in other implementations may be inflatable or partially inflatable. A thickness of the buoyant layers 14 may each be about a ¾ to about 3 inches. For example, a maximum thickness per foam layer may be about ⅝ inches.

In FIG. 3 is a side view of the mat 10 including, the netting layer 12 disposed in between the first and second buoyant layers 14. In this embodiment, each of the first and second buoyant layers 14 includes five foam layers. However, the first and second buoyant layers 14 may be constructed of more or less layers, such as one, two, three or four layers. Each foam layer may be connected together, such as by laminating. The laminating may be flame laminating. Typically the foam layers may be connected directly together, but in other implementations other layers, such as non-foam layers, may be connected between the foam layers.

The first and second buoyant layers 14 may be flame laminated together. Before the first and second buoyant layers 14 are laminated, the netting 12 is rolled out to be sandwiched between the two layers 14. As the foam is permanently adhered to each other, the sandwiched netting 12 is held securely in place. With the actual diameter of the netting being small, the holes in the netting still allow the foam to be virtually 100% adhered to each other. The size of the net openings may be between about 1/16 inches square up to about 3 inches square, such as about 3/16 inches square up to about 2 inches square, such as about ⅛ inches square up to about 1 inch square, such as about ¼ inch square up to about ½ inch square. Due to the netting 12, people are able to stand, run, jump, and do flips on the mat 10 without damage, as the pressure from the feet is spread out and carries over more area.

The present invention may further include non-foam outer layers. The non-foam outer layers may be connected onto the outer surfaces of the first and second buoyant layers 14, such as by laminating the non-foam layer to a foam layer. The foam and the non-foam may include, for example, a polyolefin material. The foam and the non-foam may further include, for example, a polyethylene. The foam may further be of ⅝ inch cross-linked polyethylene foam sheeting which may further be a chemically cross-linked two pound density material. The non-foam may be a polyolefin having an ASM tested tensile strength of, for example, 200/170 pounds when tested by the grab method. Each of the foam layers may have the same dimensions or the dimensions may vary between each layer.

The mat 10, whether constructed of one or multiple layers, may include a total thickness of about ¾ of an inch to 6 inches or more, and more particularly may be about 2 inches thick. The mat 10 may include various shapes such as a generally rectangular shape. The mat 10 may also include other shapes such as generally circular, generally triangular, and generally elliptical, or other shapes such as a trapezoid. The mat 10 may also include an abstract shape that is not generally defined. A rectangular shaped rescue mat 10 may be about five feet wide by twenty five feet long, or other variations of the length being five times greater than the width. Other sizes may also be used. Even though the mat 10 may include multiple layers, the finished product may include a substantially uniform appearance such that there are no bend or gaps in the mat 10. Alternatively or additionally, the mat 10 may include fold lines, such the mat 10 may be folded onto itself.

The mat 10 may be rolled for storage or transportation into a roll of about 4 feet wide that is about five feet tall. It may weigh about 70 pounds wet or dry. The mat 10 may be used in a playing environment. The playing environment may include a body of water such as a lake. The mat 10 may also be used on land, for example, as a water slide or gymnastic mat.

A top of the mat 10 may by manufactured of the same material as the buoyant layers 14 or other materials such as a polyurethane, to give a soft feel to an individual. A bottom and the sides of the mat 10 may be constructed from the same material as the buoyant layers 14 and may include other materials such as a durable polyethylene material to protect the foam from being punctured. The top, bottom and/or sides may also be constructed of other material such as vinyl and/or a combination of heavy vinyl and high weave count polyester to provide for additional puncture and tear resistance. At least an outer layer of the mat 10 may be weather proof, to withstand heat, cold, wind, rain and snow.

In alternate embodiments, the present invention could also be used on a mat 10 with a single foam layer by adhering the netting 14 directly to the first buoyant layer 12 without a sandwich effect. This netting 14 could also be used for repairs on existing water mats that do not currently have this layer of protection. If there is a hole in an existing mat, through the use of an adhesive, the netting or screening could be applied to both sides of the mat. The netting may extend 12" beyond the damage in all directions in order to spread out the pressure.

It should be understood, of course, that the foregoing relates to exemplary embodiments of the invention and that modifications may be made without departing from the spirit and scope of the invention as set forth in the following claims.

What is claimed is:

1. A floatable water mat comprising:

a first buoyant layer comprising at least one layer of foam, a top surface and a bottom surface opposite the top surface; and a netting comprising crisscrossing fibers adhered to the bottom surface of the first buoyant layer, wherein the crisscrossing fibers form a plurality of openings therebetween, wherein each of the plurality of openings comprises an area of at least about $1/16^{th}$ of an inch squared.

2. The floatable water mat of claim 1, wherein the first buoyant layer is non-inflatable.

3. The floatable water mat of claim 1, further comprising a second buoyant layer comprising at least one layer of foam, a top surface and a bottom surface opposite the top surface, wherein the top surface is laminated to the bottom surface of the first buoyant layer, sandwiching the netting therebetween.

4. The floatable water mat of claim 3, wherein each of the first and the second buoyant layers comprise a plurality of foam layers laminated together.

5. The floatable water mat of claim 1, wherein the netting comprises at least one of a nylon, a monofilament and a fiberglass.

6. The floatable water mat of claim 3, wherein the first and second buoyant layers each comprise polyolefin.

7. A floatable water mat comprising:

a first buoyant layer comprising at least one layer of foam, a top surface and a bottom surface opposite the top surface;

a netting comprising crisscrossing fibers disposed at the bottom surface of the first buoyant layer; and a second buoyant layer comprising at least one layer of foam, a top surface and a bottom surface opposite the top surface, wherein the top surface of the second buoyant layer is laminated to the bottom surface of the first buoyant layer sandwiching the netting therebetween.

8. The floatable water mat of claim 7, wherein each of the first and the second buoyant layers comprise a plurality of foam layers laminated together.

9. The floatable water mat of claim 7, wherein the netting comprises at least one of a nylon, a monofilament and a fiberglass.

10. The floatable water mat of claim 7, wherein the first and second buoyant layers each comprise polyolefin.

* * * * *